US008061543B2

(12) United States Patent
Baughman

(10) Patent No.: US 8,061,543 B2
(45) Date of Patent: Nov. 22, 2011

(54) PLASTIC PLUG WITH OVERCAP, INCLUDING WRENCH AND METHOD

(75) Inventor: Gary M. Baughman, Fremont, IN (US)

(73) Assignee: Rieke Corporation, Auburn, IN (US)

( * ) Notice: Subject to any disclaimer, the term of this patent is extended or adjusted under 35 U.S.C. 154(b) by 447 days.

(21) Appl. No.: 12/028,341

(22) Filed: Feb. 8, 2008

(65) Prior Publication Data

US 2009/0200259 A1 Aug. 13, 2009

(51) Int. Cl.
*B65D 55/02* (2006.01)
*B65D 51/18* (2006.01)

(52) U.S. Cl. ..... 215/217; 215/228; 220/212; 220/254.1

(58) Field of Classification Search ..... 220/212, 220/266, 265, 260, 254.1, 288, 359.4, 359.1, 220/284, 802, 801, 796, 257.1, 212.5, 254.8, 220/256.1, 293, 200, 500, 799, FOR. 105, 220/FOR. 106, FOR. 205, FOR. 203, DIG. 19; 215/302, 295, 230, 228, 217, 222, 296, 253, 215/251, 250, 200, 364, 356, 355; 81/3.41, 81/3.4, 3.29, 3.36, 3.07; 53/490, 489, 485, 53/484; D9/439, 435, 443; *B65D 51/18, B65D 51/00, 55/02*

See application file for complete search history.

(56) References Cited

U.S. PATENT DOCUMENTS

| | | | | |
|---|---|---|---|---|
| 1,645,675 | A | | 10/1927 | Warner |
| 1,656,228 | A | | 1/1928 | Parish |
| 1,845,078 | A | | 2/1932 | Draper et al. |
| 1,982,144 | A | * | 11/1934 | Shera ..... 220/257.1 |
| 1,997,203 | A | | 4/1935 | Shera ..... 220/39 |
| 2,962,185 | A | * | 11/1960 | Starr et al. ..... 220/254.8 |
| 3,122,261 | A | | 2/1964 | Parish, Jr. et al. |
| 3,187,860 | A | | 6/1965 | Simmons ..... 192/92 |
| 3,405,837 | A | * | 10/1968 | Carpenter, Jr. ..... 220/258.3 |
| 3,556,332 | A | | 1/1971 | Libit ..... 215/9 |
| 3,684,125 | A | | 8/1972 | Laurizio ..... 220/27 |
| 3,744,654 | A | | 7/1973 | Bromberg ..... 215/9 |
| 3,811,174 | A | | 5/1974 | Eichinger ..... 29/453 |
| 3,817,420 | A | | 6/1974 | Heisler ..... 220/60 R |
| 3,838,785 | A | | 10/1974 | Lancesseur ..... 215/251 |
| 3,891,118 | A | | 6/1975 | Laurizio ..... 220/288 |

(Continued)

FOREIGN PATENT DOCUMENTS

DE 1478847 3/1969

(Continued)

OTHER PUBLICATIONS

European Patent Office Search Report dated Dec. 10, 2008 from EP 08252261.6, 4 pgs.

*Primary Examiner* — Mickey Yu
*Assistant Examiner* — Robert J Hicks
(74) *Attorney, Agent, or Firm* — Woodard Emhardt Moriarty McNett & Henry LLP

(57) ABSTRACT

A closure for a container opening according to one embodiment comprises a plug including a series of projections and being constructed and arranged to be received within the container opening and an overcap constructed and arranged for being attached to the plug so as to close off an interior of the plug and create an assembly. The projections being constructed and arranged for interfit with a specialized wrench socket for threadedly advancing the plug into the container opening.

10 Claims, 8 Drawing Sheets

U.S. PATENT DOCUMENTS

| | | | | | |
|---|---|---|---|---|---|
| 3,987,929 | A | | 10/1976 | Mineo | 220/257 |
| 4,002,259 | A | | 1/1977 | Geiser | 215/216 |
| 4,105,135 | A | * | 8/1978 | Bradshaw et al. | 220/288 |
| 4,164,304 | A | * | 8/1979 | Roberson | 220/214 |
| 4,196,819 | A | * | 4/1980 | Fontanaud | 215/253 |
| 4,211,333 | A | | 7/1980 | Villarejos | 215/249 |
| 4,236,646 | A | * | 12/1980 | Ganz, Jr. et al. | 215/232 |
| 4,271,972 | A | | 6/1981 | Thor | 215/251 |
| 4,306,357 | A | | 12/1981 | Villarejos | 34/5 |
| 4,310,102 | A | | 1/1982 | Walter | 220/288 |
| 4,359,169 | A | * | 11/1982 | Helms et al. | 220/255.1 |
| 4,416,661 | A | | 11/1983 | Norman et al. | 604/86 |
| 4,588,103 | A | | 5/1986 | Baughman | 220/288 |
| 4,711,365 | A | * | 12/1987 | Fomby | 220/288 |
| 4,779,766 | A | | 10/1988 | Kinsley | 222/153 |
| 4,795,058 | A | * | 1/1989 | Hinds | 220/288 |
| 4,872,570 | A | * | 10/1989 | Harding | 215/230 |
| 4,948,006 | A | | 8/1990 | Okabe et al. | 220/67 |
| D315,309 | S | | 3/1991 | Baughman | D9/456 |
| 5,005,718 | A | * | 4/1991 | Buono | 215/220 |
| 5,080,245 | A | * | 1/1992 | Conard | 215/249 |
| 5,215,220 | A | | 6/1993 | Kreiseder et al. | 222/83 |
| 5,680,953 | A | | 10/1997 | Baughman | 220/288 |
| 5,735,419 | A | | 4/1998 | Ma | 215/253 |
| 5,823,377 | A | | 10/1998 | Krautkrämer | 220/268 |
| 5,829,611 | A | | 11/1998 | Beck | 215/252 |
| 5,862,936 | A | | 1/1999 | Johanson | 220/304 |
| 5,875,907 | A | * | 3/1999 | Lay | 215/253 |
| 5,971,183 | A | | 10/1999 | Bartsch | 215/256 |
| 5,971,189 | A | | 10/1999 | Baughman | 220/288 |
| 5,996,833 | A | | 12/1999 | Lencioni et al. | 220/257 |
| 6,247,605 | B1 | | 6/2001 | Fujie et al. | 215/256 |
| 6,360,908 | B1 | | 3/2002 | Kline | 220/257 |
| 6,726,048 | B2 | | 4/2004 | Dwinell et al. | 220/257.2 |
| 6,968,968 | B2 | | 11/2005 | Buckley et al. | 220/257.1 |
| D533,329 | S | | 12/2006 | Baughman | D34/39 |
| 2002/0112867 | A1 | | 8/2002 | Tseng | 173/93.5 |
| 2003/0071007 | A1 | | 4/2003 | Ma et al. | 215/252 |
| 2005/0133508 | A1 | | 6/2005 | Landis et al. | 220/276 |
| 2005/0242018 | A1 | | 11/2005 | Hodgin et al. | 210/198.2 |
| 2005/0258129 | A1 | | 11/2005 | Model | 215/230 |
| 2006/0092013 | A1 | * | 5/2006 | Hager et al. | 340/539.1 |
| 2006/0102583 | A1 | * | 5/2006 | Baughman et al. | 215/216 |
| 2006/0186077 | A1 | * | 8/2006 | Robinson | 215/237 |
| 2007/0158296 | A1 | | 7/2007 | Krautkramer | 215/253 |

FOREIGN PATENT DOCUMENTS

| | | | |
|---|---|---|---|
| DE | 298 21 764 | U1 | 2/1999 |
| DE | 201 05 917 | U1 | 6/2001 |
| EP | 0286230 | A1 | 10/1988 |
| EP | 0 725 013 | A1 | 8/1996 |
| EP | 2 017 185 | A2 | 1/2009 |
| FR | 2 439 721 | | 6/1980 |
| GB | 1256081 | | 2/1971 |
| WO | WO99/61334 | | 2/1999 |
| WO | WO 00/50311 | | 8/2000 |
| WO | WO 01/38177 | A2 | 5/2001 |
| WO | WO 2004/496656 | A1 | 11/2004 |

* cited by examiner

PLASTIC PLUG WITH OVERCAP, INCLUDING WRENCH AND METHOD

BACKGROUND OF THE INVENTION

The present invention relates in general to plastic plugs that are constructed and arranged to assemble into a container opening, typically by threading. The opening may be formed directly into the container or may be defined by a threaded flange. More specifically, the present invention relates to the described style of plastic plug that receives an overcap. Preferably the overcap is constructed and arranged to assemble to the plastic plug and/or container with a tamper-evident configuration and function. In the preferred embodiment the plastic plug is a unitary, molded component and the overcap is a unitary, molded plastic component. These two components are pre-assembled prior to plug insertion into the container opening without any overcap connection to the container.

When designing a closure or closure assembly that preferably includes a tamper-evident configuration or construction, it is important to consider the overall design efficiency, the reliability of the component parts as assembled and as installed, the overall cost, the physical size and the overall aesthetics, to mention some of the relevant considerations. Reliability includes not only how the tamper-evident construction functions in terms of properly revealing when a tampering attempt has been made, but also in not prematurely failing or showing a tampering attempt when none was made.

In one prior art construction, the tamper-evident component is a plastic cover that includes a skirt that cooperates with ratchet projections on an outer surface of the container opening. The size and shape complexity of this tamper-evident component adds to the component cost. The plastic plug threads into the neck opening of the container and then the tamper-evident component is engaged on the container.

In another prior art construction the tamper-evident component is of a part-metal construction in combination with a plastic overcap. A metal ring overlays the plastic skirt of the overcap such that crimping of the metal ring causes the plastic skirt to be crimped around a cooperating form on the outer surface of the container neck opening, after the plastic plug is threaded into the neck opening of the container. This tamper-evident component, similar to the first-described prior art component, is a more costly component that requires a specific style of container due to the structural cooperation between the tamper-evident overcap and the container.

In contrast to these prior art examples, the tamper-evident overcap described herein as one embodiment of the present invention provides a simpler design that engages only the plug, providing greater versatility since the container style does not have to be selected to cooperate with a particular style of tamper-evident overcap. While the plastic plug construction that is part of the prior art and depicted in part as one portion of the present disclosure includes interior structural features or forms for facilitating the threading of the plug into and out of the container neck opening, the present invention does not use those features for the initial assembly of the plug and overcap combination into the container neck opening. Instead, according to one embodiment of the present invention the tamper-evident overcap is preassembled to the plastic plug and those plug features (interior) that might otherwise be used for tightening the plastic plug into the neck opening are covered by the tamper-evident overcap. The plug and overcap constructions disclosed herein require a different method of installation and different tooling, both of which are described herein and both of which constitute an aspect of this overall invention.

The present disclosure provides a simple and reliable and aesthetically-pleasing, low cost tamper-evident overcap that assembles to the plastic plug. The overcap does not interface with the container neck opening, thereby allowing a wider range of container neck styles that remain compatible with the threaded plug. This wider range of container neck opening styles also remains compatible with the tamper-evident overcap as disclosed herein. Each outer peripheral portion of the plastic plugs disclosed herein includes unique structural forms that interfit with a unique installation tool for advancing the plug into the container opening. This unique installation tool can also be used for removing the plug from the container opening. The plug styles disclosed herein in combination with the unique installation tool comprises a container closure system.

BRIEF SUMMARY

A closure for a container opening according to one embodiment of the present invention comprises a plug including installation tool-engaging forms and an overcap, the closure being constructed and arranged to be received within the container opening, the overcap being attached to the plug so as to create an integral assembly.

One object of the present disclosure is to provide an improved closure for a container including a plastic plug and overcap.

DETAILED DESCRIPTION

Figure 1:
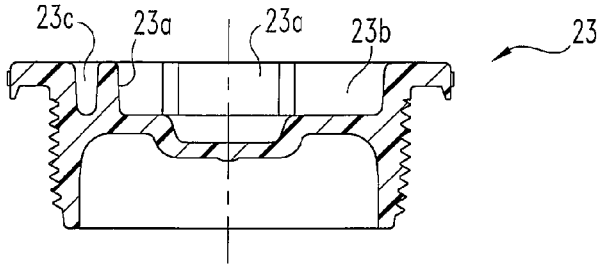
Fig. 1 (PRIOR ART)
FIG. 1 is a front elevational view, in full section, of a prior art plastic plug.
Figure 2:
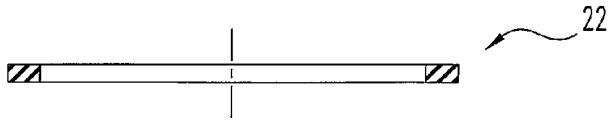
Fig. 2 (PRIOR ART)
FIG. 2 is a front elevational view, in full section, of a prior art square-cut gasket that is used with the FIG. 1 plug.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 3:
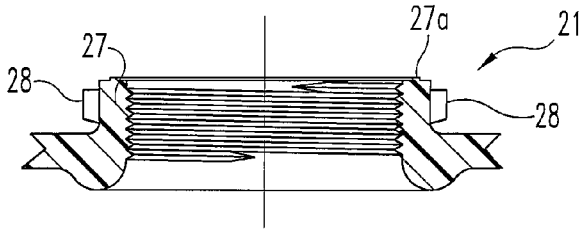
Fig. 3 (PRIOR ART)
FIG. 3 is front elevational view, in full section, of an internally-threaded container neck opening configured for connection to a tamper-evident cover.
Figure 4:
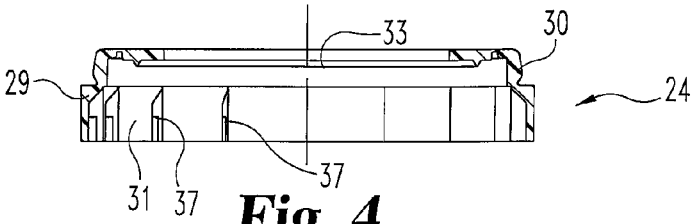
Fig. 4 (PRIOR ART)
FIG. 4 is a front elevational view, in full section, of a prior art tamper-evident cover constructed and arranged for use with the FIG. 1 plug and the FIG. 3 container neck opening.
Figure 5:
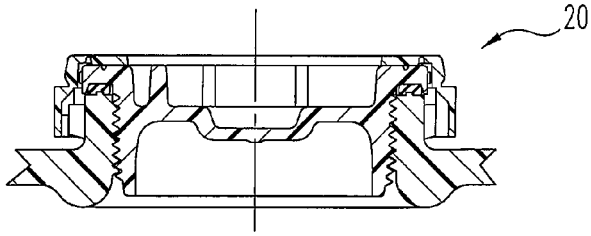
Fig. 5 (PRIOR ART)
FIG. 5 is a front elevational view, in full section, of the prior art combination of the plug, gasket, cover and container neck opening as illustrated in FIGS. 1-4.
Figure 6:
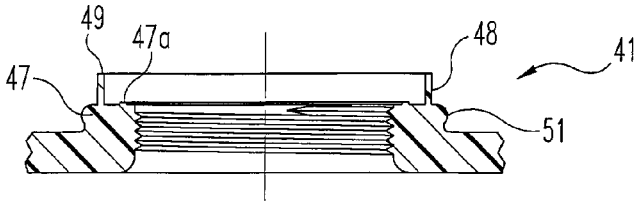
Fig. 6 (PRIOR ART)
FIG. 6 is a front elevational view, in full section, of an alternative prior art container neck opening.
Figure 7:
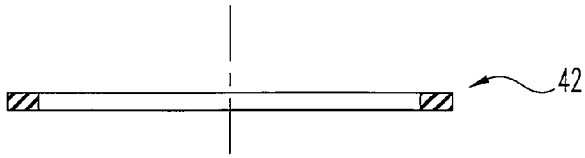
Fig. 7 (PRIOR ART)
FIG. 7 is a front elevational view, in full section, of a prior art square-cut gasket.
Figure 8:
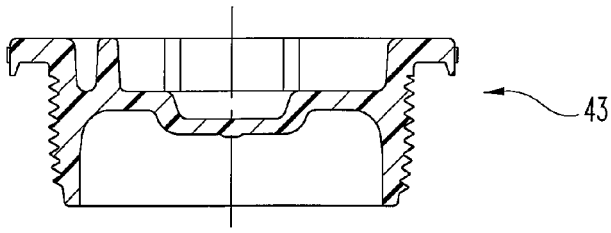
Fig. 8 (PRIOR ART)
FIG. 8 is a front elevational view, in full section, of a prior art plastic plug constructed and arranged to be installed into the FIG. 6 container neck opening.
Figure 9:
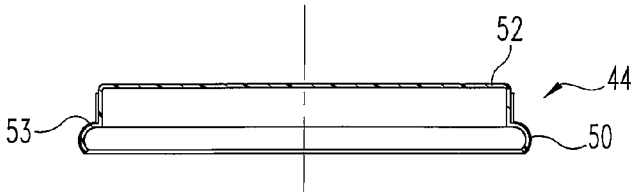
Fig. 9 (PRIOR ART)
FIG. 9 is a front elevational view, in full section, of a prior art tamper-evident overcap constructed in a range for use with the FIG. 8 plastic plug.

Referring to FIGS. 1-5, a prior art closure system 20 is illustrated. System 20 includes a container opening 21, square-cut gasket 22, a unitary, molded plastic plug 23 and a unitary, molded plastic tamper-evident cover 24. The assembly of component parts 22-24 into container opening 21 is illustrated in FIG. 5. In this prior art embodiment (system 20) the cylindrical wall 27 that defines internally-threaded opening 21 includes at least one ratchet tab 28, two of which are illustrated in FIG. 3. The tamper-evident cover 24 includes a lower skirt 29 connected to cover body 30. The inside surface 31 of skirt 29 includes a series of ratchet teeth 37 for engagement with tabs 28 so as to prevent removal. The center portion 33 of cover body 30 is constructed and arranged for access to the top interior portion of plug 23.

The recessed interior portion of plug 23 includes a shelf and is integrally formed with four, equally-spaced, raised bosses 23*a* extending above the shelf. A recessed area 23*b* between each adjacent pair of bosses 23*a* results from this spaced-apart construction. Each boss 23*a* defines an interior opening 23*c*. This structural configuration on the interior portion of plug 23 enables plug 23 to be removed by the use of a cooperatively-styled wrench that is available from the plug manufacturer. When tamper-evident cover 24 is properly installed or assembled, the interior portion of plug 23 is accessible. This same construction is applicable to plug 43 as described hereinafter. System 20 represents one style of prior art closure and container design that is being improved upon by the embodiments of the present disclosure.

Figure 10:
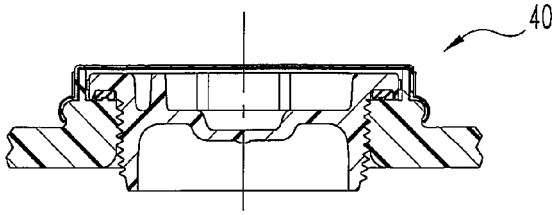
Fig. 10 (PRIOR ART)
FIG. 10 is a front elevational view, in full section, of the combination of the components and structures illustrated in FIGS. 6-9.
Figure 11:
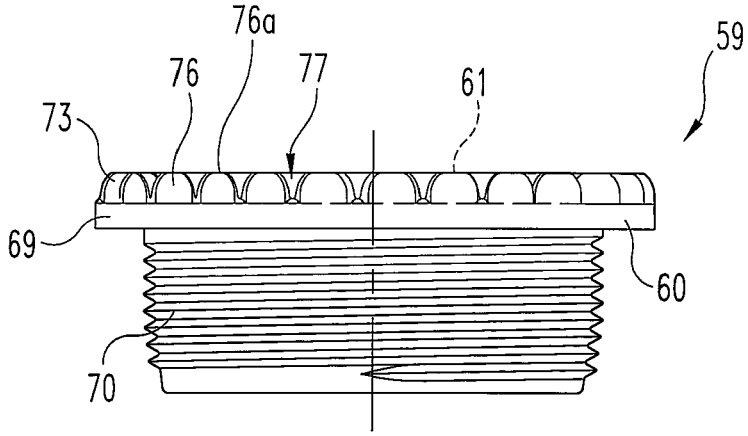
FIG. 11 is a front elevational view of a plastic closure according to a typical embodiment of the present invention.
Figure 12:
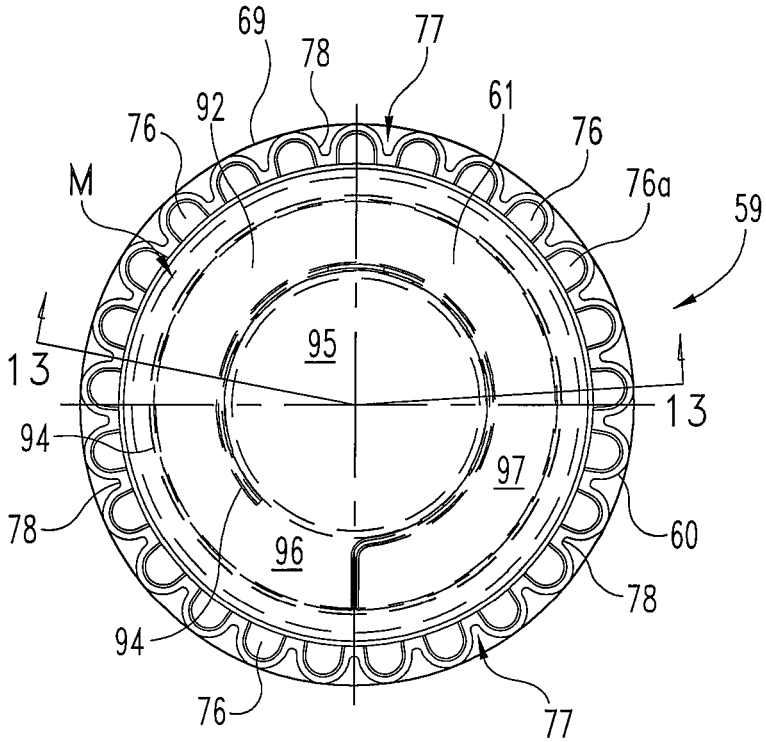
FIG. 12 is a top plan view of the FIG. 11 plastic closure.

Referring to FIGS. 6-10, another prior art closure system 40 is illustrated. System 40 includes a container opening 41, a gasket 42, a unitary, molded plastic plug 43 and tamper-evident cover 44. The assembly of component parts 42-44 into container opening 41 is illustrated in FIG. 10. In this prior art embodiment (system 40) the annular wall 47 that defines internally-threaded opening 41 includes a generally cylindrical wall extension 48. The tamper-evident cover 44 rests on the upper edge 49 of wall extension 48 while lower skirt 50 wraps around annular form 51. Tamper-evident cover 44 includes a unitary, molded plastic body 52 and a surrounding metal shell 53. Shaping or crimping of the metal shell 53 is used so as to conform the plastic to, around, and beneath annular form 51. The plastic portion of tamper-evident cover 44 must be defeated in order to have access to the top interior portion of plug 43. System 40 represents another style of prior art closure and container design that is being improved upon by the present invention.

Each cylindrical wall 27 and 47 includes a raised annular rib 27*a* and 47*a*, respectively, that is embedded into its corresponding gasket 22 and 42, respectively. Gaskets 22 and 42 are substantially identical to each other in form, fit, and function. In this particular application as disclosed for the two prior art systems, gaskets 22 and 42 are square-cut gaskets that fit between the radial flange of the plastic plug and the upper surface of the wall that defines the container neck opening. With regard to the plastic plugs 23 and 43, these two components are substantially identical to each other in form, fit and function.

Referring now to FIGS. 11-16, a novel and unobvious closure 59 is illustrated. Closure 59 includes a plastic plug 60 and a cooperating plastic overcap 61, the details of each being illustrated in FIGS. 11-16. With continued reference to FIGS. 11, 13, and 15, the unitary plastic plug 60 is similar to prior art plugs 23 and 43, except for the unique contouring or shaping of the peripheral portion 68 of the radial flange 69 of plastic plug 60. Radial flange 69 extends radially outwardly from the threaded body 70 and terminates in short, depending axial wall 71 that helps to define inverted gasket channel 72. The upper surface 73 of flange 69 is shaped or contoured with a uniform, equally-spaced series of curved, raised projections 76. Each rounded projection 76 has a generally part-hemispherical shape with a curved or rounded outer edge or surface form and appearance in a top plan view (see FIG. 15) and a curved or rounded upper edge or surface form and appearance in a front or side elevational view (see FIG. 11). Since the uppermost surface 76*a* of each projection 76 includes a small flat area, the overall projection 76 form is best described as "part-hemispherical".

In the exemplary embodiment of closure 59, as illustrated by FIGS. 11-16, plug 60 includes twenty-five (25) projections 76 that are uniformly spaced and integrally connected or linked by recessed portions 77. This arrangement of projections has the shape of an annular ring. Although the preferred embodiment provides a full or complete ring, it is envisioned that gaps could be left. This results in arcs or sectors of projections 76. The concave edge 78 of each portion 77 is located at approximately the diameter of the curved or rounded outer or upper portion of each projection 76. As further described herein, once the overcap is securely attached to the top, center portion of flange 69, the wrench forms 79 on the interior of the plug 60 are covered over and are not accessible to the installer until such time as the overcap 61 is defeated or removed. It therefore becomes necessary to provide some means, method, structure and/or tooling to be able to properly grip onto closure 59 in order to securely and tightly thread the closure (actually the plug portion of the closure) into the container opening 62.

The projections 76 provide the means and structure for installing the closure 59 into the container opening 62. The tooling that is used for this installation is "socket" wrench 82 (see FIGS. 17A and 17B). The head 83 of the socket is recessed and shaped with generally part-hemispherical recesses 85 in the form of small, rounded pockets that are equal in number and sized and arranged in terms of their spacing and overall geometry to fit securely over the entire series of projections 76 with a secure and reliable interfit, as would be expected from a properly sized and shaped socket wrench. The bottom or base 85*a* of each socket recess 85 includes a small flat area that generally matches its counterpart area of projection surface 76*a*. Even if the projections 76 are not arranged as a full, continuous annular ring, the socket recesses 85 can be a full annular ring, as the "extra" recesses merely fit into the gaps. The matching shape, number, and spacing of recesses 85 relative to projections 76 ensures that rotation of the socket, specifically rotation of the socket head, results in rotation of the plug 60 and thus rotation of the closure 59 as it is advanced into threaded engagement into the container opening. The properly aligned interfit of the recesses 85 securely on top of, over, and around the projections 76 means that, once properly aligned, there should be no slippage or disconnect in the form of the socket ramping off of the individual projections. If the socket recesses 85 are not properly aligned onto the raised (part-hemispherical) projections 76, then it might be possible for the wrench 82 to slip off of or out of engagement. The part-hemispherical form of the projections 76 and the cooperating part-hemispherical form of the recesses 85 means that any such slippage or slide off will not damager either the plug 60 or the wrench 82. Based on the front elevational views provided and the top plan views provided for the recesses 85 and the projections 76, the overall geometry and shape of those structural portions is fully illustrated. It is also to be understood that the male-female configuration could be reversed, so long as the matching geometry remains the same. Based on the shape and appearance and the compound curvatures provided, use of the term "part-hemispherical" is believed to be the most appropriate in order to describe the specific geometry. However, that term is not intended to be limiting, as virtually any type of rounded form would be suitable, so long as there is an adequate raised and recessed extent on the two cooperating forms sufficient to provide an interfit that would then enable the wrench to drive the plug without slippage. Whatever geometry or shape is selected for the raised projections 76, the geometry and shape of each recess 85 needs to match. Whatever the number of each form, there needs to be a sufficient degree of interfit or engagement such that rotation of the socket transmits into rotation of the plug.

In terms of the unique configuration of plug 60 as provided by projections 76, the key is that wrench 82 is a specialized, unique, non-standard design whose availability and distribution is strictly controlled. Wrench 82 is made available only to authorized installers, as selected by the owner of this design, such as container or drum manufacturers and fillers. Unless wrench 82 is available, there is no other accessible structural portion or feature of closure 59 that can, from a practical standpoint, be used for installing the closure 59. If it becomes necessary at some point in the overall cycle of the drum to remove the closure without first defeating and/or removing the overcap 61, then wrench 82 would be required for that removal step, at least in a practical sense such that the closure 59 is not damaged. With regard to this potential removal step, consider that it might be desired to install the closure 59 in the container opening before filling for convenience in transporting the drum to the filler. This would necessitate as really the only practical way or means, use of wrench 82 to reliably and securely install the closure in the drum opening. Then, at the filler's location, the closure needs to be removed for filling and fitting the recesses 85 of the wrench 82 over the projections 76 is the only practical and effective way to do so. The use for wrench 82 is to fit onto projections 76 for rotation and use of projections 76 is to be able to install and remove closure 59.

When reference is made to the only practical way or means of advancing plug 60 into the container opening, it should be understood that this is in the context of not altering, mutilating, or damaging the plug. With overcap 61 securely attached to the plug such that the wrench forms 79 on the interior portion of plug 60 are not accessible, see FIG. 13, the only practical way to connect to plug 60 for threaded advancement and tightening is to fit wrench 82 over projections 76 and thereby utilize the interfit of recesses 85.

Figure 13:
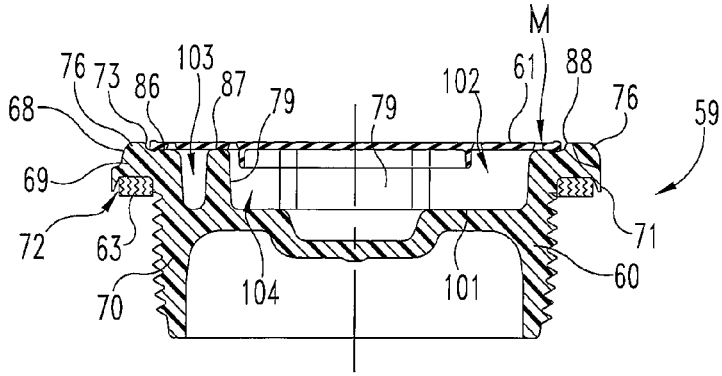
FIG. 13 is a front elevational view, in full section, of the FIG. 11 plastic closure.
Figure 14:
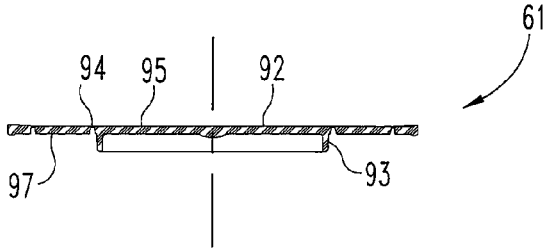
FIG. 14 is a front elevational view, in full section, of a tamper-evident overcap comprising one portion of the FIG. 11 plastic closure.
Figure 15:
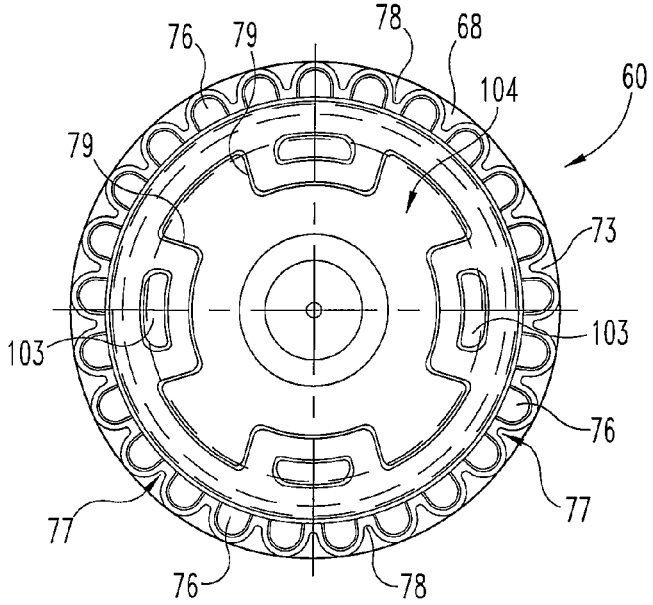
FIG. 15 is a top plan view of a plastic plug comprising one portion of the FIG. 11 plastic closure.
Figure 16:
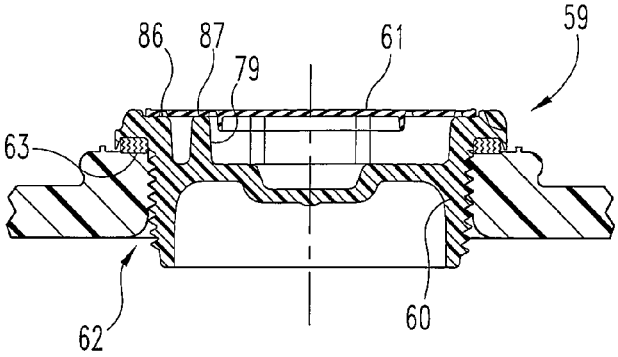
FIG. 16 is a front elevational view, in full section, of the FIG. 11 plastic closure, as installed in a container opening.

With continued reference to FIGS. 11-16, the overcap 61 of closure 59 is attached to the upper surface 73 of radial flange 69 so as to close off the interior portion and deny access to the wrench forms 79. The preferred method of attachment of overcap 61 to plug 60 is by ultrasonic spot welding. The spot weld locations can be on the recessed annular ring surface 86 or on the upper surface 87 of one or more of the wrench forms 79, or both, see FIG. 15. Between the projections 76 and recess surface 86, there is an annular rib 88 that generally coincides in height to the uppermost edge or surface of each projection. Surface 86 is axially below the uppermost edge or surface of each projection 76 and of rib 88 (see FIG. 13) by a distance the generally corresponds to the thickness of the overcap 61. This relationship is illustrated in FIG. 13 and helps explain why the overcap 61 is not otherwise visible in FIG. 11.

Overcap 61 is a relatively thin, unitary plastic member having an upper panel 92 and an interior, depending annular wall 93. The upper panel 92 defines a weakened score line 94 that creates a circular pull tab 95 that connects at portion 96 to annular ring 97. The weakened score line 94 extends around pull tab 95 and extends around annular ring 97. Annular ring 97 is a tear-out portion. When overcap 61 is applied to plug 60, see FIGS. 12 and 13, the area directly beneath pull tab 95 is open, making it easy to punch tab 95 free and thereafter be in a position for grasping. By grasping tab 95, the ring 97 is able to be separated from the upper panel 92 of the overcap 61. This in turn provides an opening of sufficient size for tightening (the threaded advancement) and loosening (threaded removal) of plug 60 using the interior wrench forms 79 of plug 60, as described below.

The construction and arrangement of overcap 61, including its generally smooth and flat upper surface of panel 92 and its relative position on plug 60, allows overcap 61 to be used for indicia marking, customer logos, etc. The edge area marked as "M" in FIGS. 12 and 13 includes an approximate starting location or outer edge for such indicia marking, customer logos, etc. Whether used for company advertising, instructions, or warnings, overcap 61 provides a practical location due to its visibility. When the overcap 61 is pulled free of plug 60, any such indicia marking, etc., would be removed. This provides for initial or first-use instructions without the markings or logos remaining a part of the closure once it is put into service. Overcap 123 has a similar construction and a similar capability in terms of indicia marking, etc., as described for overcap 61.

The plug 60 includes an interior shelf 101 and the open space 102 above shelf 101 includes radially inwardly-projecting wrench forms 79 and alternating recesses 104. Each wrench form 79 defines a central opening 103. These interior shapes that are defined above shelf 101 are used for plug tightening and removal after initial opening. As described, the overcap 61 is securely attached to the plug 60 prior to initial assembly of the combination into the threaded container opening 62. While we have described the use of wrench 82 as the specialized tooling for the installation of closure 59 into the container opening 62, once the tamper-evident overcap 61 is opened by tearing out a portion of the upper panel 92, more conventional equipment or tooling can be used in cooperation with the plug 60 interior shapes or forms to permit removal of the plug from opening 62 and to permit reclosing of the opening 62 with plug 60. The threaded style for the threaded body 70 of plug 60 is preferably a buttress thread or pipe thread (as shown).

Figure 17A:
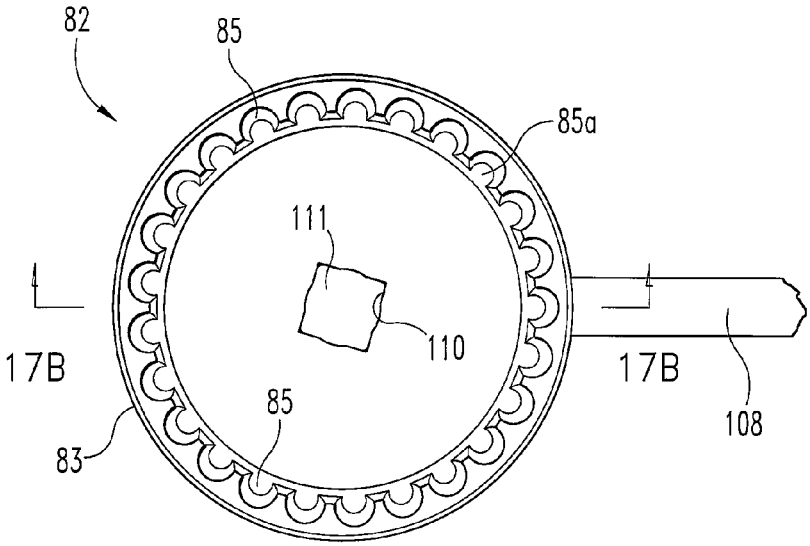
FIG. 17A is a bottom plan view of a socket wrench uniquely styled to fit forms provided as part of the FIG. 11 plastic plug.
Figure 17B:
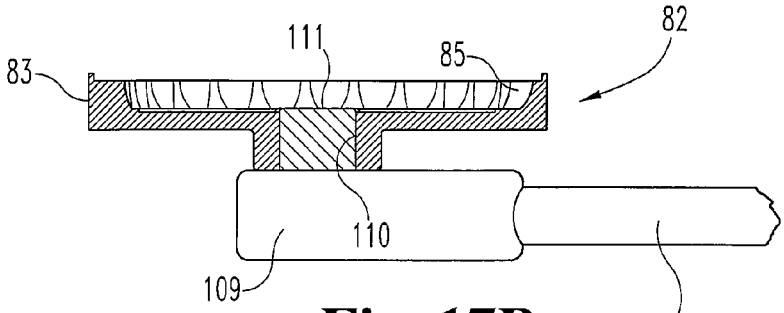
FIG. 17B is a side elevational view, in full section, of the FIG. 17A socket wrench.

With continued reference to FIGS. 17A and 17B, the socket wrench 82 includes a wrench handle 108 for grasping and this wrench handle is constructed and arranged to connect to the open socket head 83 with a releasable square drive. Preferably, the distal end 109 of socket wrench 82 includes a reversible, ratchet construction and a quick release for the square drive connection. The square opening 110 in head 83 is centered in head 83 and is constructed and arranged for receipt of the square drive post 111 of socket wrench 82. With the unique shaping and contouring of socket head 83, socket wrench 82 can be otherwise of conventional construction.

In terms of the method of installation of closure 59, the first or preliminary step is to securely attach overcap 61 to plug 60 in order to create the integral assembly that is closure 59. The initial threading of closure 59 into the container opening 62, or at least the starting of that threading, begins by aligning the threaded body of plug 60 with opening 62. It is anticipated that the initial or lead in threading would be started by hand so as to prevent or at least reduce the risk of cross threading. Initially, the plug 60 will thread into opening 62 very easily and, once started, the manual rotation can be replaced by the use of wrench 82. As has been described, the uniquely-styled wrench 82 is fitted down onto the plug 60 so that recesses 85 align with and receive the projections 76. This ball and socket-type of fit allows torque to be transferred from the socket head through projections 76 to plug 60. As the socket head of wrench 82 turns or rotates, that motion is imparted to the plug 60. The turning of the plug advances the closure 59 into the opening 62 of the container. Continued turning and tightening by use of wrench 82 securely and fully seats the closure 59 in the container opening 62. If the overcap 61 is not defeated or removed such that the interior wrench forms are not accessible, then the removal of closure 59 out of container opening 62 would be performed by following the same steps, except in reverse order.

Referring now to FIGS. 18-22, an alternative closure 120 is illustrated. Initially it should be noted that closure 120 is constructed and arranged in a manner that is generally equivalent to closure 59, except for the part-hemispherical, raised projections 76 that are replaced with gear teeth 121 as part of closure 120. The description herein of "gear" teeth is intended to suggest the general dentate profile shape of these forms rather than gear ratios or drive trains. Plug 122 is generally equivalent to plug 60 and the overcap 123 is identical to overcap 61. The weakened score line 124 over overcap 123 is the same as the weakened score line 94 of overcap 61. The assembly of the overcap to the plug is the same for closure 120 as it is for closure 59. The interior forms of plug 122 are identical to the interior forms of plug 60. The only structural difference between closure 120 and closure 59 is the construction and configuration of plug 122 versus plug 60. The only structural difference between plug 122 and plug 60 is the exchange or replacement of part-hemispherical projections 76 by gear teeth 121.

Figure 18:
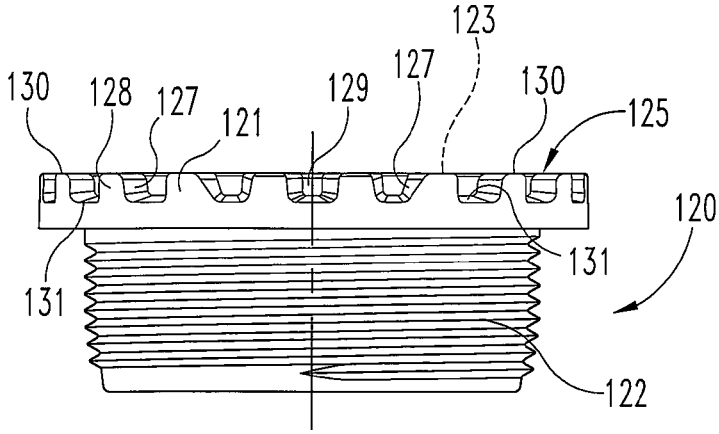
FIG. 18 is a front elevational view of a plastic closure according to another embodiment of the present invention.
Figure 19:
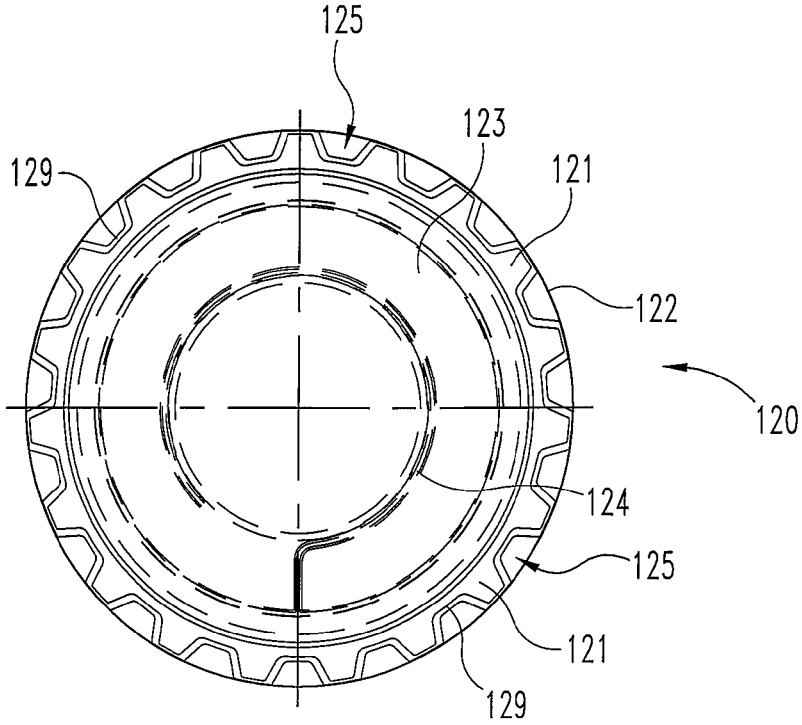
FIG. 19 is a top plan view of the FIG. 18 plastic closure.
Figure 20:
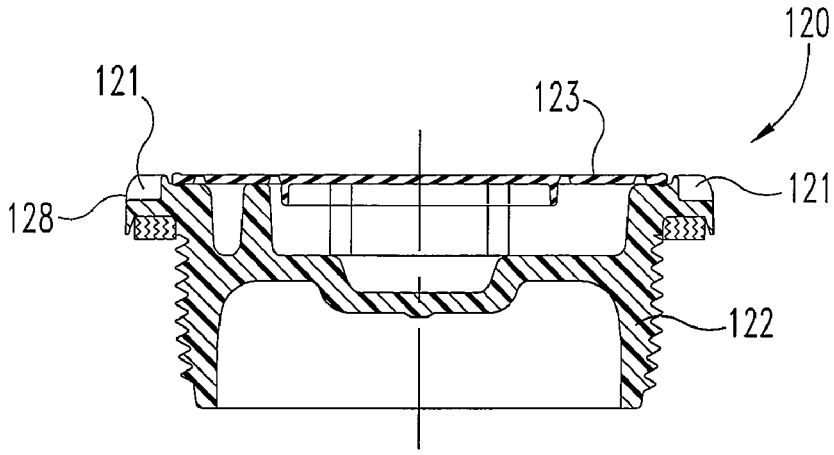
FIG. 20 is a front elevational view, in full section, of the FIG. 18 plastic closure.
Figure 21:
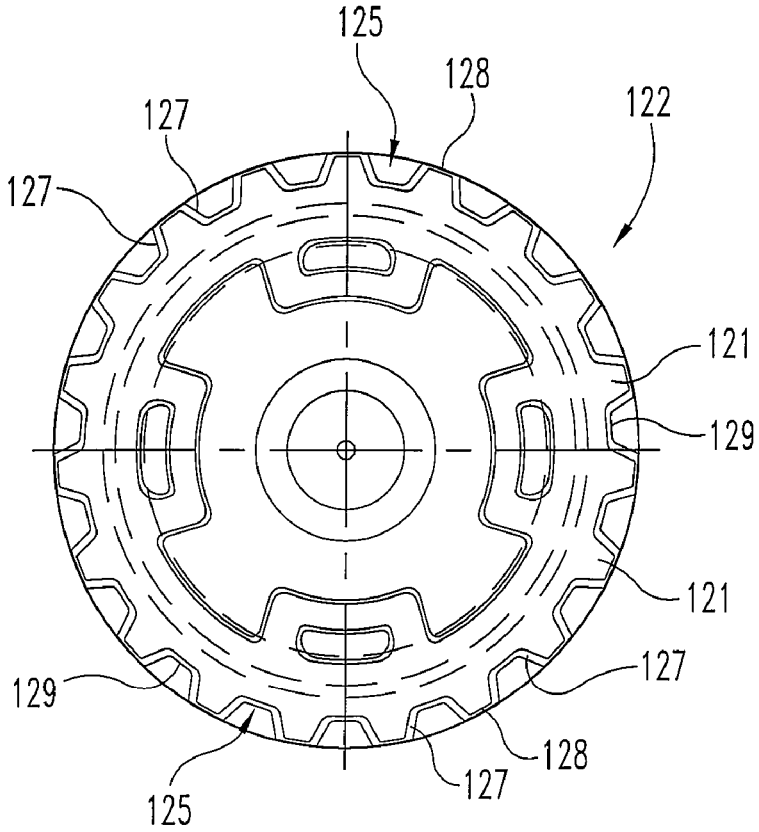
FIG. 21 is a top plan view of a plastic plug comprising one portion of the FIG. 18 plastic closure.
Figure 22:
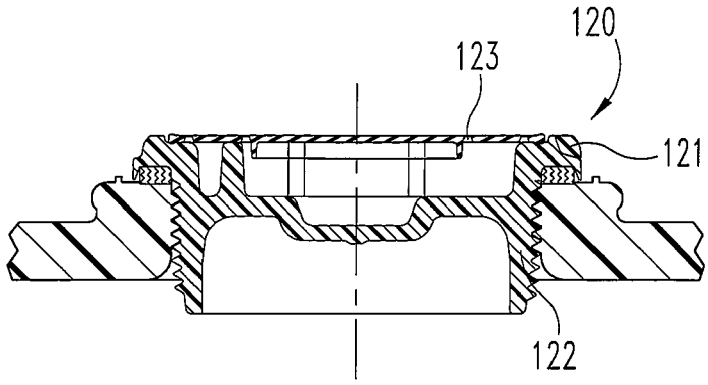
FIG. 22 is a front elevational view, in full section, of the FIG. 18 plastic closure as installed into a container opening.

Referring now to FIGS. 18 and 21, the details of plug 122 and gear teeth 121 are illustrated. FIGS. 19, 20 and 22 illustrate the relationship between plug 122 and overcap 123. These three drawing figures also help to illustrate the relationship between the nineteen (19) gear teeth 121 and overcap 123. The nineteen gear teeth 121 are equally-spaced and, between each adjacent pair of gear teeth 121, a recess 125 is defined. This alternating structure and arrangement of teeth 121 and recesses 125 is illustrated in FIGS. 18, 19 and 21.

The front elevational shape of each gear tooth 121 and of each recess 125 is illustrated in FIG. 18. The top plan shape of each gear tooth 121 and of each recess 125 is illustrated in FIGS. 19 and 21. Each gear tooth 121 has diverging sides 127 moving from outer surface 128 radially inwardly to the radial base or root surface 129 of each. The matching, inverse shape of each recess 125 includes converging sides (radially inwardly) 127 that correspond to the diverging sides of the corresponding gear tooth 121. The upper surfaces 130 of each gear tooth 121 are coplanar and collectively define the uppermost surface of the plug 122. The axial height of each gear tooth 121 is defined as the distance from the axial base 131 to the upper surface 130. Each gear tooth 121 includes axially diverting sides moving in the direction from the upper surface 130 to the axial base 131.

Figure 23:
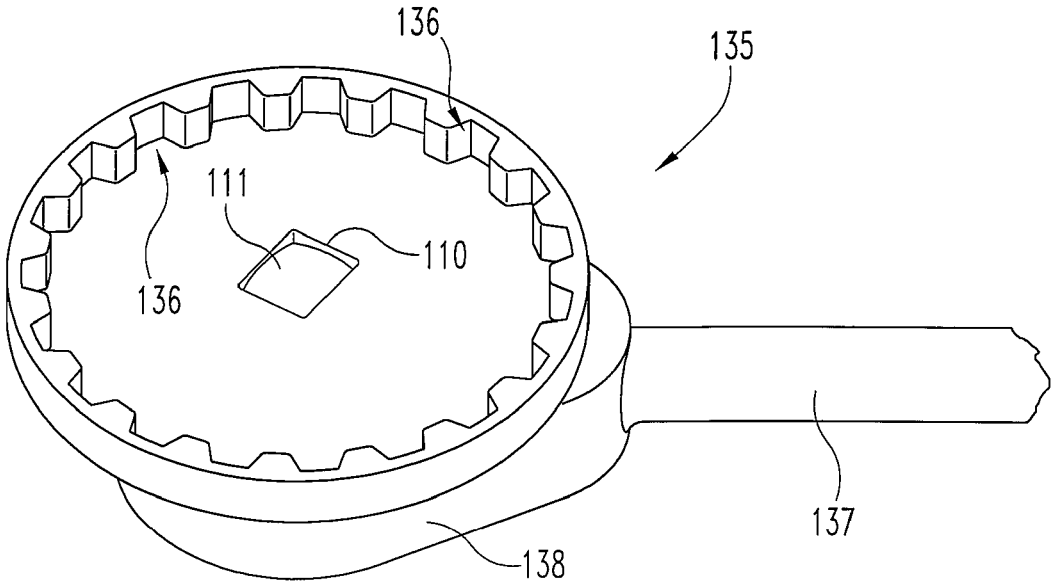
FIG. 23 is a perspective view of a socket wrench uniquely styled to fit forms provided as part of the FIG. 18 plastic closure.

Referring now to FIG. 23, socket wrench 135 is identical to socket wrench 82 with the exception of the part-hemispherical recesses 85 now being replaced by gear teeth recesses 136. The handles 137 and 108 and the ratchet mechanisms at the distal ends 138 and 109 are identical. The square openings and square drive posts are identical. The only difference is to replace the part-hemispherical recesses 85 that match projections 76 with gear teeth recesses 136 that match the number, size, shape, and spacing of gear teeth 121. Socket wrench 135 is used to advance and remove plug 122 as desired, particularly when overcap 123 is attached such that the interior forms of the plug are not accessible.

The first embodiment of FIGS. 11-16 uses projections 76 that are raised in an axial direction and thus the socket fit is axial. The recesses 85 fit downwardly over the projections 76. This is why gaps in the annular ring form on plug 60 in terms of the number of projections 76 is not an issue of the interfit, only an issue of torque. The second embodiment of FIGS. 18-22 uses dentate shapes (gear teeth 121) that project radially outwardly. Since the recesses 125 between adjacent teeth are open from the top, the socket wrench 135 still fits down over the gear teeth. If a full annular ring of gear teeth 121 is not provided, gaps resulting from the elimination of a tooth or teeth will not interfere with the socket recesses 136.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A closure for a container opening comprising:

a plug constructed and arranged with a plurality of part-hemispherical projections, said plug including an interior shelf and a plurality of wrench forms and is constructed and arranged to be received within said container opening; and a tamper-evident overcap initially attached to said plug so as to create an integral assembly and so as to deny access to said plurality of wrench forms, wherein with said overcap attached to said plug, said part-hemispherical projections remain exposed for use in advancing said plug into said container opening, and wherein said plug further includes an annular rib positioned between said part-hemispherical projections and said overcap.

2. The closure of claim 1 wherein said overcap is attached to said plug by an ultrasonic weld.

3. The closure of claim 1 wherein said overcap includes an upper panel defining a tamper-evident tear-out portion.

4. The closure of claim 3 wherein said tear-out portion is defined by a weakened score line.

5. The closure of claim 1 wherein said overcap includes an upper surface that is constructed and arranged to receive indicia marking.

6. A closure for a container opening comprising:

a plug constructed and arranged with a plurality of gear tooth projections, said plug including an interior shelf and a plurality of wrench forms and is constructed and arranged to be received within said container opening; and a tamper-evident overcap initially attached to said plug so as to create an integral assembly and so as to deny access to said plurality of wrench forms, wherein with said overcap attached to said plug, said gear tooth projections remain exposed for use in advancing said plug into said container opening, and wherein said plug further includes an annular rib positioned between said gear tooth projections and said overcap.

7. The closure of claim 6 wherein said overcap is attached by an ultrasonic weld.

8. The closure of claim 6 wherein said overcap includes an upper panel defining a tamper-evident tear-out portion.

9. The closure of claim 8 wherein said tear-out portion is defined by a weakened score line.

10. The closure of claim 6 wherein said overcap includes an upper surface that is constructed and arranged to receive indicia marking.

* * * * *